United States Patent [19]

Woodward et al.

[11] Patent Number: 4,758,135

[45] Date of Patent: Jul. 19, 1988

[54] PUMP HEAD

[75] Inventors: Michael J. Woodward, Houston; Robert S. Judson, Wharton, both of Tex.

[73] Assignee: Weatherford U.S., Inc., Houston, Tex.

[21] Appl. No.: 947,838

[22] Filed: Dec. 30, 1986

[51] Int. Cl.[4] ..... F04B 39/10; F04B 39/14; F16J 15/18; B65D 53/00

[52] U.S. Cl. ..... 417/559; 417/454; 417/571; 92/168; 277/35; 277/60; 277/71

[58] Field of Search ..... 92/168; 417/559, 454, 417/571; 277/9, 35, 60, 71, 123

[56] References Cited

U.S. PATENT DOCUMENTS

| | | | |
|---|---|---|---|
| 2,230,501 | 2/1941 | MacArthur | 277/60 |
| 2,841,092 | 7/1958 | Whiteman et al. | 277/123 |
| 3,373,695 | 3/1968 | Yohpe | 417/454 |
| 3,598,418 | 8/1971 | Ward | 277/71 |
| 3,785,659 | 1/1974 | Maurer | 277/35 |
| 3,811,801 | 5/1974 | Buse | 417/454 |
| 3,870,439 | 3/1975 | Stachowiak et al. . | |
| 3,907,307 | 9/1975 | Maurer | 277/71 |
| 4,141,676 | 2/1979 | Janner | 417/539 |
| 4,277,229 | 7/1981 | Pacht | 417/454 |
| 4,551,077 | 11/1985 | Pacht | 92/168 |
| 4,621,566 | 11/1986 | Johnson | 417/454 |

FOREIGN PATENT DOCUMENTS

| | | | |
|---|---|---|---|
| 197755 | 5/1923 | United Kingdom | 417/571 |

OTHER PUBLICATIONS

"Recommended Practices for the Use of Manually Operated High Pressure Water Jetting Equipment", The Water Jet Technology Association, Jun. 1985, p. 4, Section 4.0; p. 8.

*Primary Examiner*—William L. Freeh
*Attorney, Agent, or Firm*—Vaden, Eickenroht Thompson & Boulware

[57] ABSTRACT

A pump and a stress and fatigue resistant pump head, one embodiment of which is useful for a high pressure pump and having a manifold, a valve cartridge, inlet and outlet valves in the valve cartridge, a pump fluid cylinder with a reciprocating plunger therein, a packing cartridge with packing for the plunger. The pump head may exhibit one or more of the following features: a. increased diameter packing cartridge; b. increased length front bushing; c. inclined inlet valve; d. inlet valve spring in valve cartridge on manifold side of valve; e. decreased diameter of high pressure seal of packing cartridge.

6 Claims, 2 Drawing Sheets

31f
41
30c
50
10
52
11f
51
22
21
12f
15
18
12c
12b
19
16
40b
11b
A
11g
11a
A
67
61
21
14a
19a
14
11f
42
14b
11
23
31f
30
12f
17
65
12
11c
40
12a
12c
60
15a
31

A
G
E
F
B
C
D

PUMP HEAD

BACKGROUND OF THE INVENTION

1. Field of the Invention

This invention relates to pumps and particularly to positive displacement pumps for high pressure applications.

2. Description of the Prior Art

High pressure pumps are used in water blasting systems to blast away scale, deck paint, rust or contaminants with a high pressure stream of water. Such systems have applications in oil refineries, chemical plants, oil field operations, offshore operations, and marine industries. Pumps capable of producing pressures up to 50,000 psi have been used with both water systems and water-and-sand-injection systems. These pressurizing pumps are designed to deliver high pressure water or other fluid and are usually based on positive displacement pistons or rubber/diaphragm/hydraulic systems. They may discharge the water or fluid into a common manifold to which are connected flexible hoses or rigid tubings which in turn have nozzles or lances connected to them. The pumps can be mobile or permanently mounted.

U.S. Pat. No. 3,870,439 discloses a fluid end or head for a high pressure pump which is designed specifically for high pressure cleaning service. It has been made with stainless steel parts which afford corrosion resistance and relatively long service life and it has been provided with a modular design which permits quick and easy maintenance. The fluid end can be overhauled in less than two hours and the suction and discharge valves are contained in a clamped valve seat that is easily removable for maintenance. The fluid end also has self-adjusting plunger packing contained inside a removeable cartridge for quick removal, inspection or replacement. Peak pressures developed by the pump plunger, particularly during cavitation, are transmitted to the valve seat unit and to the pump plunger packing rather than to the much more expensive pump manifold.

Despite the advantages and success of the pump fluid end of U.S. Pat. No. 3,870,439, failures have occurred while a pump with such an end operated above pressures of 12,500 p.s.i. High cyclic stresses at high pressures have caused such pump fluid ends to fail due to metal fatigue at a variety of locations within the fluid end. Typical fatigue points include: the packing-cartridge-fluid-cylinder interface; the recess for a front bushing; a recess within the fluid cylinder for the packing spring; recess for the suction valve spring; and a recess for a discharge valve flow.

SUMMARY OF THE INVENTION

The present invention teaches a novel and unique high pressure pump head which overcomes the problems and disadvantages associated with prior art heads. Specifically, a pump head according to the present invention has an enhanced ability to withstand the fatigue of high pressure and continuous cycling over long periods of time. Such a pump head has a fluid cylinder connected to a retainer plate which is connected to a pump manifold. The manifold has an inlet recess containing a suction valve. This inlet recess communicates with a fluid cylinder recess in which is disposed a plunger. A packing cartridge is threadedly connected to and disposed partially within an end of the fluid cylinder. The plunger moves in the fluid cylinder recess and within a recess in the packing cartridge. The suction valve inlet recess communicates with both the fluid cylinder recess containing the plunger and with a discharge recess which contains a discharge valve. Packing is disposed within the fluid cylinder recess and extends into the recess within the packing cartridge nut. The packing serves the purpose of sealing between the plunger and the packing cartridge.

The packing cartridge has a significantly larger outer diameter than prior art cartridges. A packing spring is placed within the fluid cylinder recess for urging the packing in a direction away from the retainer plate for the purpose of maintaining load on the packing to effect a seal between the plunger and the packing cartridge. O-ring seals are employed at either end of the packing cartridge nut for insuring the sealed contact of the nut and the fluid cylinder. Front and rear bushings (or front and rear "brasses") are provided within the fluid cylinder recess and the packing cartridge nut recess about the plunger for aligning the plunger within the pump. A lube channel is provided from the exterior of the fluid cylinder, through the packing cartridge nut, to the rear bushing for the purpose of providing lubrication to the rear packing.

A "pony rod extension" connects a power end to the pump plunger and permits removal of the plunger from the pump head without having to remove the pump head from the power end. Capscrews can be used to hold the manifold, retainer plate, and fluid cylinder in sealing contact. The suction valve is spring loaded so that it will close quickly. On the suction stroke water moves from the suction manifold, past the suction valve, and into the fluid cylinder. On the discharge stroke, the suction valve closes stopping flow through the fluid cylinder back into the suction manifold. In some prior art valves, the suction valve spring was located on the fluid cylinder and this configuration caused fatigue cracks (see "D", FIG. 2) in the fluid cylinder. In a pump head according to the present invention, a high pressure seal is located at the interface between the fluid cylinder and the packing cartridge. By decreasing the diameter of the high pressure seal, the load on the packing nut threads is reduced (since load is directly proportional to the area, i.e., also to the diameter; thus as the diameter is decreased while pressure is held constant the load is decreased). A prior art Frontier pump has an inclined inlet suction valve recess, but it differs from a head according to the present invention in that the Frontier pump recess is in a manifold rather than in a valve seat cartridge.

It is therefore an object of the present invention to provide a novel pump and pump head which overcome the problems associated with prior art pumps and pump heads.

Another object of the present invention is the provision of a pump head which is not subject to fatigue at high pressures and which does not fail under high cylical stresses.

A further object of the present invention is the provision of a pump head having an inlet channel and an inlet valve in the inlet channel, the channel and valve being inclined with respect to the horizontal axis of the pump head.

Yet another object of the present invention is the provision of a pump head having a packing cartridge of increased outer diameter.

A still further object of the present invention is the provision of a pump head having a front bushing in a fluid cylinder, the front bushing having increased length for reducing stress.

Another object of the present invention is the provision of a pump head having a packing cartridge and a packing nut on the packing cartridge with a decreased diameter of high pressure seal to reduce the load on the seal and reduce fatigue failure at the threads in the fluid cylinder (see "A", FIG. 2).

A particular object of the present invention is to provide a reliable and safe pump head which can be operated efficiently at pressures above 12,500 psi.

To one of skill in this art who has the benefits of the teachings of this invention, other and further objects and advantages will be clear from the following drawings and description of embodiments preferred on the date of filing of this application.

DESCRIPTION OF PREFERRED EMBODIMENTS

Figure 1:
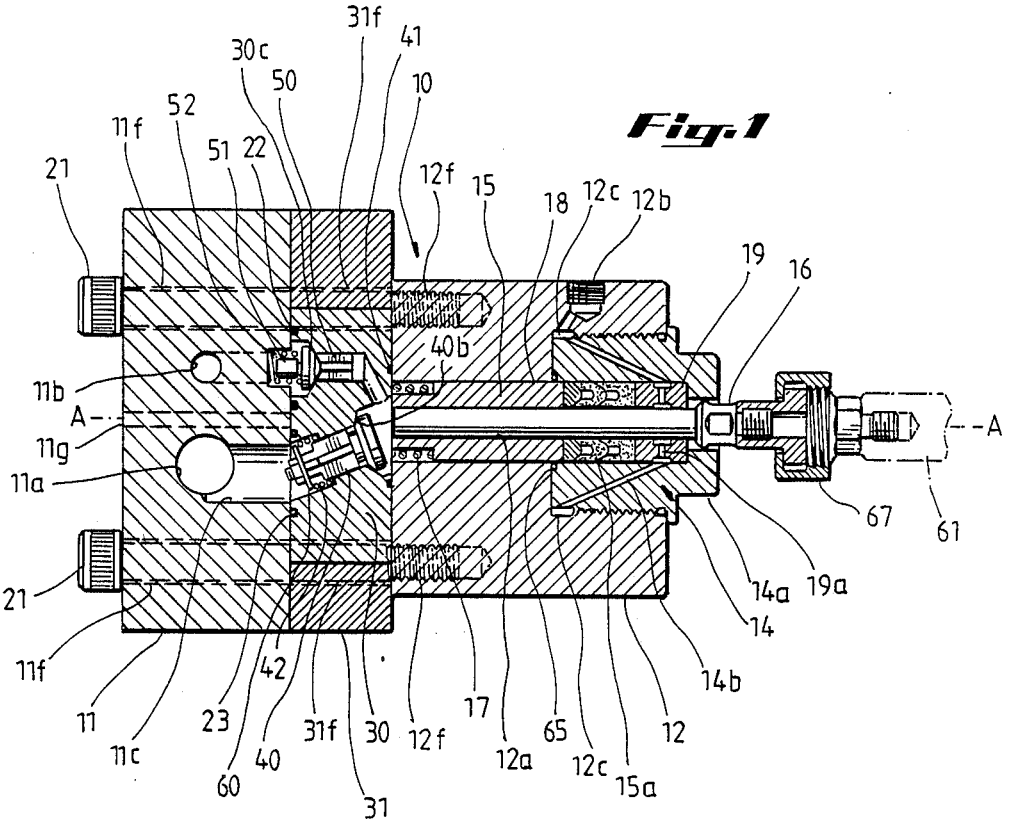
FIG. 1 is a sectional view of a pump head according to the present invention showing the fluid end of a high pressure pump.

In FIG. 1 the numeral 10 refers generally to one embodiment of a pump head according to the present invention. A manifold block 11 is disposed adjacent to a retainer plate 31 and a valve cartridge 30. A fluid pump cylinder 12 is disposed adjacent to the plate 31 and cartridge 30. The fluid cylinder 12 has a packing cartridge 14 disposed therein and threadedly connected thereto through which a plunger or piston 16 moves in response to power supplied through a typical cross head 61. The cross head 61 is connected to a pony rod extension 67 to which is connected the plunger 16.

The manifold 11 has an inlet opening 11*a* through which is suppled the fluid to be pumped. The manifold 11 also has an outlet opening 11*b* for the discharge of pumped fluid. The inlet opening 11*a* connects with a channel 11*c* which in turn communicates with a valve cartridge inlet channel 30*a*. The outlet opening 11*b* connects with a channel 11*d* which in turn communicates with a valve cartridge outlet channel 30*b*. The valve cartridge channels 30*a* and 30*b* communicate via a valve cartridge channel 30*c*. To provide sealing between the manifold 11 and the valve cartridge 30, O-ring seals 22 and 23 are disposed about the openings of the channels 30*b* and 30*a*, respectively.

The manifold 11, retainer plate 31, valve cartridge 30 and fluid cylinder 12 are secured together by cap screws 21 which extend through holes 11*f*, 31*f*, and 12*f* thereby securing these elements together. Each cap screw 21 has a threaded end which threadedly mates with a threaded portion of the holes 12*f* of the fluid cylinder 12.

The valve cartridge 30 has two valves, an inlet suction valve 40 and an outlet discharge valve 50. The inlet valve 40 is disposed in the valve cartridge inlet channel 30*a* for movement therein and it seats upon an annular valve seat 40*b* which has a spherical shape in cross-section to conform with a corresponding surface on the valve 40 for effectively closing off fluid flow through the channel 30*a* when the valve 40 is in the seated position. A spring 42 acts to keep the valve 40 seated until the pump operates on the suction stroke. The spring 42 is biased against the spring retainer 60. The channel 30*a* is inclined from the horizontal axis of the head (line A—A, FIG. 1), preferably at about 21½ degrees from the horizontal.

The valve 50 is adapted to seat on the annular valve seat 30*e* of the valve cartridge outlet channel 30*b*. The valve 50 has a spring guide stem 51 around which is positioned a spring 52 which serves to seat the valve 50 until a predetermined pressure urging it to an unseated position is acting on the valve 50.

The valve 40 permits fluid flow from the inlet opening 11*a* of the manifold 11 to the fluid cylinder 12, into a fluid cylinder recess 12*a* within the cylinder 12 in which the plunger 16 reciprocates. During such flow the valve 50 is retained in seated or closed position. When the reverse occurs, and the plunger 16 moves toward the manifold 11, fluid is permitted to flow from the fluid cylinder recess 12*a* to the outlet opening 11*b* by opening the outlet valve 50; the inlet valve 40 remains closed to prevent fluid from flowing out through the inlet opening 11*a*.

A fluid seal is maintained between the valve cartridge 30 and the fluid cylinder 12 by an O-ring seal 41.

Figure 3:
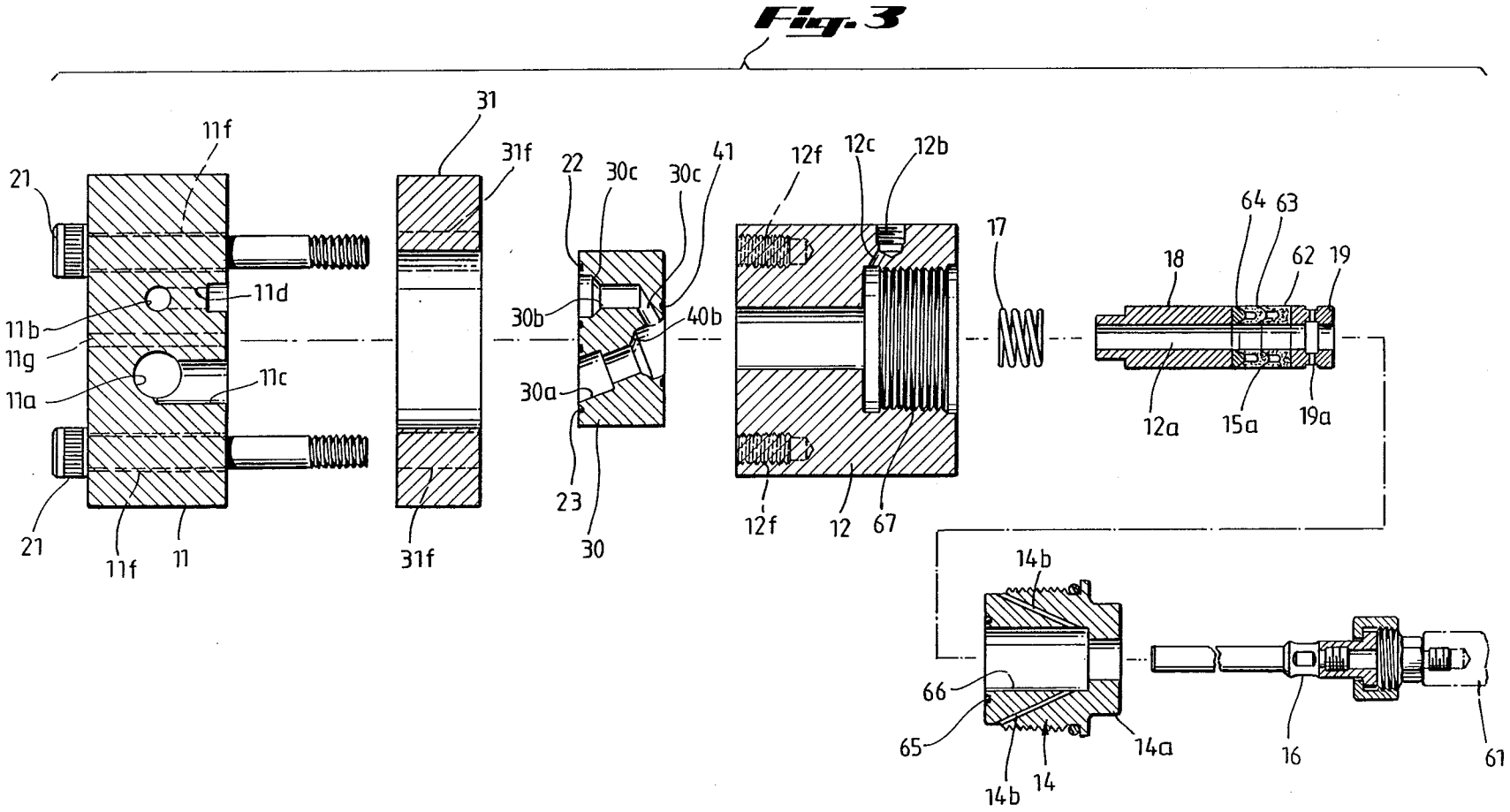
FIG. 3 is an exploded sectional view of the pump head of FIG. 1.

A variety of combinations of V-packings or chevron packing rings may be used for the packing set 15*a*. Generally from two to eight rings are used. As shown in FIGS. 1 and 3, the set 15*a* includes a combination of three rings or members—a pressure ring 62, a center ring 63, and a front ring 64. These rings may be made of cotton duck cloth or cotton duck cloth and nylon cloth impregnated with hard flexible nitrile, Teflon (TM) material or of conventionally available packings.

A sealing device is provided between the packing cartridge 14 and the pump fluid cylinder 12. In the preferred embodiment of FIG. 3, this sealing device is the O-ring 65. By positioning this O-ring closer to the recess wall 66 of the packing cartridge than to the threads 67 of the pump fluid cylinder, the diameter of the O-ring is reduced as compared to O-rings in prior art heads; i.e., in prior art heads O-rings are positioned much closer to the outer periphery of the packing cartridge which necessitates a relatively larger O-ring (see High Pressure Seal G, FIG. 2). Larger O-rings present more surface to coact with fluid pressure; i.e., they experience a greater load. Re-positioning an O-ring closer to the interior recess of the packing cartridge (and closer to the interior recess of the pump fluid cylinder) results in an O-ring of reduced diameter—i.e., one which is subjected to a lesser load.

Lubricant such as grease is injected into the packing rear bushing 19 (made of metal, brass, steel, or plastic of suitable hardness) through a lube inlet 12*b* in the fluid cylinder 12 which communicates with a lube channel 12*c* which in turn communicates with a lube channel 14*b* in the packing cartridge 14 and a lube hole 19*a* in the rear bushing 19. A front bushing 18 (made of brass, steel, or plastic, e.g.) holds pressure on the packing 15 and provides some guidance for the plunger 16.

A weep hole 11*g* through the manifold 11 serves the purpose of indicating when seals 23 and 22 have failed or when something in the interior of the head has cracked. Water or other pumped fluid comes out of the weep hole upon the occurrence of such a failure.

In operation, the plunger 16 is connected to the pony rod extension 67 which is connected to a conventional cross head 61 which is in turn connected to a conventional prime mover (not shown) for reciprocating the plunger 16 within the fluid cylinder 12. The manifold 11 is connected to a source of fluid to be pumped, and the manifold outlet 11*b* is connected to a pipe, hose or receptacle which receives the fluid being pumped.

When the plunger 16 moves away from the manifold 11, the suction stroke occurs and fluid is drawn into the recess 12*a* by flowing through the suction valve 40 from the inlet 11*a* of the minifold 11. At that time the valve 50 is closed by the spring pressure of the spring 52 and by the reduced internal pressure of the recess 12*a* which is less than the fluid pressure on the other side of the valve 50.

On the pumping stroke the plunger 16 moves towards the manifold 11, forcing fluid through the valve 50 and out of the manifold through the outlet opening 11*b*. At that time the valve 40 is closed. By unthreading the capscrews 21, the valve cartridge 30 can be removed. The packing cartridge may be removed by wrenching the packing nut 14*a* thereby exposing the entire bore holding the packing 15, for inspection, repair, or replacement.

Figure 2:
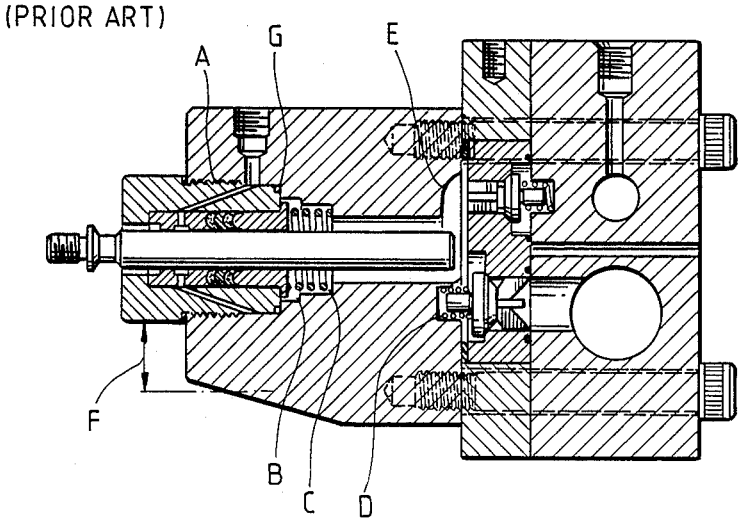
Fig.2 (PRIOR ART)
FIG. 2 is a sectional view of a prior art pump head.

As shown in FIG. 2, prior art devices experience fatigue and failure at the points A, B, C, D, and E. These points are identified as follows:

A. threads in the fluid cylinder;
B. recess for front brass (or bushing);
C. recess for packing spring;
D. recess for valve spring; and
E. recess for discharge valve flow.

Failure at these points have been discovered at operating pressures above 12,500 psi, and after 100,000 cycles of operation. Such failures require expensive repair or replacement of parts or entire pump heads and result in operation downtime. To overcome these deficiencies and problems, pump heads according to the present invention may have the following novel characteristics which are presently in preferred embodiments of the invention:

1. Stress at point A is reduced by reducing the outer diameter of the high pressure seal of the packing cartridge, preferably by about 50%.
2. Stress at points B and C is reduced by increasing the length of the front brushing, preferably by about 300%.
3. Stress at points D and E is reduced by inclining the suction valve 40 from the horizontal (preferably at about 21½ degrees) and by placing the suction valve spring 42 on the manifold side of the valve, thereby reducing or eliminating stress concentrations.

To one of skill in this art who has the benefit of this invention's teachings it will be clear that other and further embodiments of this invention are possible without departing from the spirit of the invention as defined in the scope of the following claims.

What is claimed is:

1. A pump head comprising manifold means having an inlet suction opening and an outlet discharge opening valve cartridge means adjacent to and connected to the manifold means, said valve cartridge means having an opening channel communicating with the manifold means' inlet suction opening and having a discharge channel communicating with the manifold means' outlet discharge opening, the valve cartridge means having suction valve means disposed in its opening channel for selectively closing off the opening channel and discharge valve means in the discharge channel for selectively closing off the discharge channel, pump fluid cylinder means adjacent to and connected to the valve cartridge means, said pump fluid cylinder means having a reciprocable plunger movably mounted in a pump fluid cylinder recess in the pump fluid cylinder, the pump fluid cylinder recess communicating with the valve cartridge means' opening channel, so that upon movement of the plunger away from the manifold means the suction valve means permits fluid to flow from the manifold means inlet suction opening into the pump fluid cylinder recess, and upon movement of the plunger toward the manifold means the discharge valve means permits fluid to flow to the outlet discharge opening of the manifold means, the pump fluid cylinder recess having an outer portion of larger diameter than an inner portion, the outer portion suitable for receiving and engaging a packing cartridge nut and the outer portion having an inner shoulder surface, packing cartridge means receivable in the pump fluid cylinder means and having a plunger recess therein communicating with the pump fluid cylinder recess for movement of the plunger therein, the packing cartridge means having packing therein for encircling the plunger, the packing cartridge including a generally cylindrical packing cartridge nut receivable in the pump fluid cylinder recess and having an inner end for contacting the shoulder surface of the outer portion of the pump fluid cylinder recess and having an exterior threaded cylindrical surface for engagement with mating threads provided on the pump fluid cylinder recess, the packing cartridge nut having a packing recess therein for holding the packing and an opening through which the plunger movably extends, the inner end of the packing cartridge nut having an indented portion about the periphery of the interior edge thereof, and an O-ring seal disposed in the indented portion about the periphery of the interior edge of the packing cartridge nut for providing sealing between the packing cartridge nut and the pump fluid cylinder means.

2. The pump head of claim 1 including a spring for selectively maintaining the suction valve means in a closed position until a predetermined pressure is reached, the spring positioned in the opening channel on the valve cartridge means on the manifold means' side of the suction valve and the spring disposed so that pumped fluid flows through the spring.

3. The pump head of claim 1 wherein a bushing spring is disposed within the pump fluid cylinder recess and wherein the pump head has a front bushing, the front bushing having a substantial portion thereof disposed within the pump fluid cylinder recess inner portion and a portion thereof disposed within the packing cartridge means, the front bushing having an end portion extending into the bushing spring and occupying a substantial portion of the space within the spring, the spring urging the front bushing against the packing.

4. The pump head of claim 1 wherein the suction valve means' channel is inclined from the horizontal axis of the pump head with an inlet end thereof lower from the horizontal than an outlet end thereof.

5. The pump head of claim 4 wherein the suction valve means channel and the suction valve means are inclined at an angle of about 21½ degrees.

6. A pump head comprising manifold means having an inlet suction opening and an outlet discharge opening valve cartridge means adjacent to and connected to the manifold means, said valve cartridge means having an opening channel communicating with the manifold means' inlet suction opening and having a discharge channel communicating with the manifold means' outlet discharge opening, the valve cartridge means having suction valve means disposed in its opening channel for selectively closing off the opening channel and discharge valve means in the discharge channel for selectively closing off the discharge channel, pump fluid cylinder means adjacent to and connected to the valve cartridge means, said pump fluid cylinder means having a reciprocable plunger movably mounted in a pump fluid cylinder recess in the pump fluid cylinder, the pump fluid cylinder recess communicating with the valve cartridge means' opening channel, so that upon movement of the plunger away from the manifold means the suction valve means permits fluid to flow from the manifold means inlet suction opening into the pump fluid cylinder recess, and upon movement of the plunger toward the manifold means the discharge valve means permits fluid to flow to the outlet discharge opening of the manifold means, the pump fluid cylinder recess having an outer portion of larger diameter than an inner portion, the outer portion suitable for receiving and engaging a packing cartridge nut and the outer portion having an inner shoulder surface, a bushing spring being disposed within the inner portion of the pump fluid cylinder recess, packing cartridge means receivable in the pump fluid cylinder means and having a plunger recess therein communicating with the pump fluid cylinder recess for movement of the plunger therein, the packing cartridge means having packing therein for encircling the plunger, the packing cartridge including a generally cylindrical packing cartridge nut receivable in the pump fluid cylinder recess and having an inner end for contacting the shoulder surface of the outer portion of the pump fluid cylinder recess and having an exterior threaded cylindrical surface for engagement with mating threads provided on the pump fluid cylinder recess, the packing cartridge nut having a packing recess therein for holding the packing and an opening through which the plunger movably extends, the inner end of the packing cartridge nut having an indented portion about the periphery of the interior edge thereof, and an O-ring seal disposed in the indented portion about the periphery of the interior edge of the packing cartridge nut for providing sealing between the packing cartridge nut and the pump fluid cylinder means, a front bushing, the front bushing having a substantial portion thereof disposed within the pump fluid cylinder recess inner portion and a portion thereof disposed within the packing cartridge means, the front bushing having an end portion extending into the bushing spring and occupying a substantial portion of the space within the spring, the spring urging the front bushing against the packing.

the suction valve means' channel is inclined from the horizontal axis of the pump head with an inlet end thereof lower from the horizontal than an outlet end thereof, and a spring for selectively maintaining the suction valve means in a closed position until a predetermined pressure is reached, the spring positioned in the opening channel on the valve cartridge means on the manifold means' side of the suction valve and the spring disposed so that pumped fluid flows through the spring.

* * * * *